US010704154B2

(12) United States Patent
Scholes

(10) Patent No.: US 10,704,154 B2
(45) **Date of Patent: *Jul. 7, 2020**

(54) ANODE CLAMPING DEVICE

(71) Applicant: VALLEY WEST WELDING CO., INC., Waverly, TN (US)

(72) Inventor: Alan Morris Scholes, Waverly, TN (US)

(73) Assignee: Valley West Welding Co., Inc, Waverly, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,912

(22) Filed: Apr. 15, 2019

(65) Prior Publication Data

US 2020/0040476 A1 Feb. 6, 2020

Related U.S. Application Data

(63) Continuation of application No. 16/051,480, filed on Jul. 31, 2018, now Pat. No. 10,260,158.

(51) Int. Cl.
*C25C 3/12* (2006.01)
*C25C 3/16* (2006.01)

(52) U.S. Cl.
CPC . *C25C 3/12* (2013.01); *C25C 3/16* (2013.01)

(58) Field of Classification Search
CPC ..... C25C 3/10; C25C 3/12
See application file for complete search history.

(56) References Cited

U.S. PATENT DOCUMENTS 3,093,369 A * 6/1963 Duclaux ..... H01R 4/50 269/221
3,752,465 A * 8/1973 Siegmund ..... C25C 3/16 204/288.4
3,803,012 A * 4/1974 Kurr ..... C23F 13/02 204/196.16

* cited by examiner

*Primary Examiner* — Ciel P Contreras
(74) *Attorney, Agent, or Firm* — Michael D. Eisenberg

(57) ABSTRACT

An anode clamp configured for clamping an anode rod to an anode bus, the anode clamp comprising a first rotating mechanism and a second rotating mechanism. The first rotating mechanism is configured to be rotated by a user and is in contact with the second rotating mechanism. When the first rotating mechanism is rotated, it causes the second rotating mechanism to rotate. The second rotating mechanism as a pawl which is configured for being rotated downwards to apply pressure on an anode rod located below the pawl.

3 Claims, 17 Drawing Sheets

ANODE CLAMPING DEVICE

CROSS-REFERENCES TO RELATED APPLICATIONS

This application is a continuation of U.S. application Ser. No. 16/051,480 filed Jul. 31, 2018, now U.S. Pat. No. 10,260,158 which is hereby incorporated herein by reference in its entirety.

TECHNICAL FIELD

The present application, in some embodiments thereof, relates to the field of aluminum smelting, which is the production of molten aluminum form ore. More specifically, the present invention relates to anode clamps for clamping an anode rod to an anode bus bar.

BACKGROUND

In the aluminum smelting industry, anode rods are clamped to anode bus bars in order to maximize the passage of electrical current between the anode bus bars and the anode rods. As the anode rods wear down, the clamps pressuring the anode rods to the bus bars are manipulated to keep the pressure of the anode rods constant against the anode bus bars, thereby keeping the passage of electrical current constant as well.

The force applied by the clamp to an anode bar is generally around 12,000 lbs. In order to withstand and transfer such a high force, the clamp is to be structurally and materially strong. Otherwise, the clamp may be prone to brakeage.

In the prior art, the parts of the clamp are generally made with cast iron components that are expensive to source and have long lead times. Moreover, the cast iron parts often have voids in the metal causing structural weakness. Castings are also sometimes not dimensionally consistent in their shape, causing problems in fitting parts together. The present invention eliminates the need for the use of cast iron.

BRIEF SUMMARY OF THE INVENTION

The present invention, in some embodiments thereof, relates to an anode clamp configured to clamp an anode rod to an anode bus. In the clamp of the present invention, the cylindrical section of the cam has a larger arc than the clamp known in the prior art, such that the tooth of the first gear touches the tooth of the second gear when the cam and the roller are still in contact. In this manner, when the cam loses contact with the roller, the contact between the teeth of the first and second gears is not violent, and the teeth are less likely to break.

In some embodiments of the present invention, the first pin has an open channel near the top of the first pin rather than a hole. The dowel pin passes through the channel, such that a bottom portion of the dowel pin is held in the channel, while a top portion of the dowel pin is held by another channel in the cam-gear assembly. In this manner, the cross-sectional surface of the first pin is increased with respect to the cross-sectional surface of the first pin of the prior art. This increases the torsional strength of the first pin, increases the service life of the square pin, and reduces the maintenance required. The present invention does not require the frequent replacement of broken split pins known in the prior art.

In some embodiments of the present invention, at least some of the parts are made with stock steel and then welded together. For example, the cam and first gear are made of different pieces and then welded together. The pawl is made of different pieces welded together. The second gear is a different piece welded to the pawl.

The different pieces may be fabricated from steel plate (e.g., a36 steel plate). The individual components may be cut on a burning table then welded together in a jig to form the completed assembly. Steel material has 30% stronger tensile strength while being lighter, aiding in assembly. Dimensional shape is more consistent, greatly improving part fitment in the clamp.

In some embodiments of the present invention, the portion of the pawl that contacts the anode rod includes an electrically insulating block. This prevents electrical current flow through the clamp, thus preventing high temperatures sometimes experienced through the electric current flow.

Therefore, an aspect of some embodiments of the present invention relates to an anode clamp configured for clamping an anode rod to an anode bus, the anode clamp comprising a first rotating mechanism and a second rotating mechanism. The first rotating mechanism comprises a first pin, a cam, and a first gear. The first pin is rod-shaped and configured for being rotated by a user around a longitudinal axis of the first pin. The cam has a main body shaped as an arc of a cylinder, the cam having an outer surface having a cylindrical section and a non-cylindrical section, the cam being joined to the first pin such that a central axis of the cylinder is parallel to and separate from the longitudinal axis of the first pin, the cam being configured to rotate with the first pin around the longitudinal axis of the first pin. The first gear is joined to the cam, the first gear having at least one first tooth extending radially away from the first pin, the at least one tooth being adjacent to the non-cylindrical section of the cam and opposite to the cylindrical section of the cam. The second rotating mechanism comprises a second pin, a pawl, a roller, and a second gear. The second pin is parallel to the first pin. The pawl is joined to the second pin and rotatable around the second pin, the pawl comprising a clamping pad configured to contact the anode rod and apply pressure on the anode rod located below the clamping pad, the clamping pad comprising an electrically insulating block configured to contact the anode rod and to prevent electrical current flow from the anode rod to the clamp. The roller is parallel to the first pin and joined to the pawl such that the rotation of the roller does not cause the pawl to rotate, the roller being configured to contact the cylindrical section of the cam's outer surface. The second gear joined to the pawl and rotatable around the second pin, the second gear having at least one second tooth extending radially away from the second gear and configured to engage with the at least one first tooth. A first rotation of the first rotating mechanism in a first direction around the longitudinal axis of the first pin causes the cam to roll against the roller, such that a distance between a point at which the cam touches the roller from a center of the first pin becomes larger due to the fact that the main body of the cam is off-center with respect to the longitudinal axis of the first pin, thereby pushing the roller and causing the second rotating mechanism to rotate in a second direction opposite to the first direction around the second pin. The second rotation of the second rotating system being such that the clamping pad of the pawl rotates downward to apply pressure on the anode rod. During the first and second rotation, the at least one first tooth is configured to contact the at least one second tooth before the roller loses contact with the cylindrical section of the outer surface of the cam.

In a variant, the first pin has a first open channel cut near a top of the first pin, the open channel being substantially perpendicular to the longitudinal axis of the first pin. The cam comprises an extension extending longitudinally away from the main body, the extension being traversed by a hollow straight duct perpendicular to a longitudinal axis of the main body. The duct has two openings at a surface of the extension. A portion of the duct is a second open channel, such that the second open channel of the duct is aligned with the first open channel when the first pin is inserted in the cam, and when the second open channel and the first open channel are aligned, the first open channel and the second open channel form a closed conduit. The first rotating mechanism comprised a dowel pin, configured for being inserted through one of the openings into the closed conduit, thereby joining the cam with the first pin.

In another variant, the pawl comprises two vertical walls parallel to each other, and the clamping pad extending between the two vertical walls. Each of the vertical walls has a first opening and a second opening, the first openings being configured to be traversed to and secured to the second pin, and the second openings being configured to be partially traversed by the roller and to secure the roller.

In still a further variant, a clamp comprises a first pin that is rod-shaped and configured for being rotated by a user around a longitudinal axis of the first pin. The claim comprises a cam having a main body shaped as an arc of a cylinder. The cam has an outer surface having a cylindrical section and a non-cylindrical section and the cam is joined to the first pin such that a central axis of the cylinder is parallel to and separate from the longitudinal axis of the first pin. The cam is configured to rotate with the first pin around the longitudinal axis of the first pin. The main body of the cam is off-center with respect to the longitudinal axis of the first pin. The first pin has a first open channel cut near a top of the first pin, and the open channel is substantially perpendicular to the longitudinal axis of the first pin.

In yet another variant of the clamp, the cam comprises an extension extending longitudinally away from the main body. The extension is traversed by a hollow straight duct perpendicular to a longitudinal axis of the main body. The duct has two openings at a surface of the extension. A portion of the duct is a second open channel, such that the second open channel of the duct is aligned with the first open channel when the first pin is inserted in the cam. When the second open channel and the first open channel are aligned, the first open channel and the second open channel form a closed conduit.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
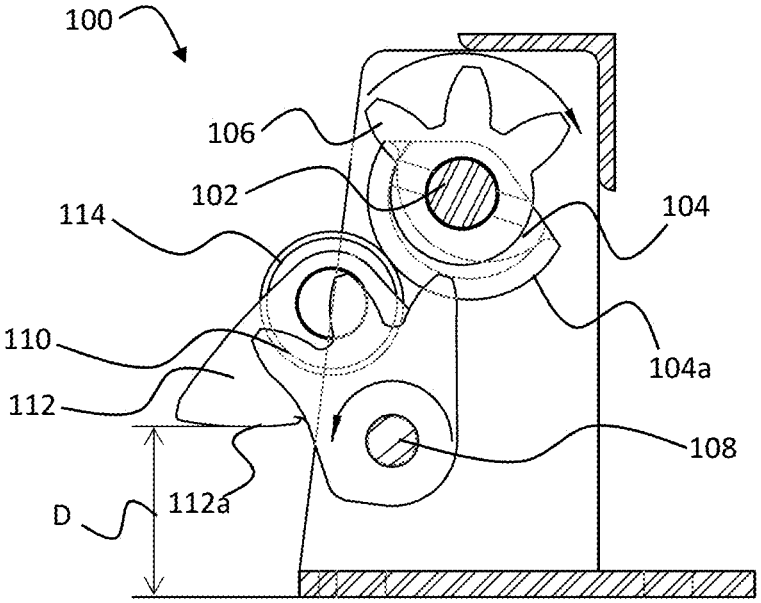
Fig. 1 (Prior Art)
FIGS. 1-3 are side views showing different stances of an anode clamp as known in the general art.
Figure 2:
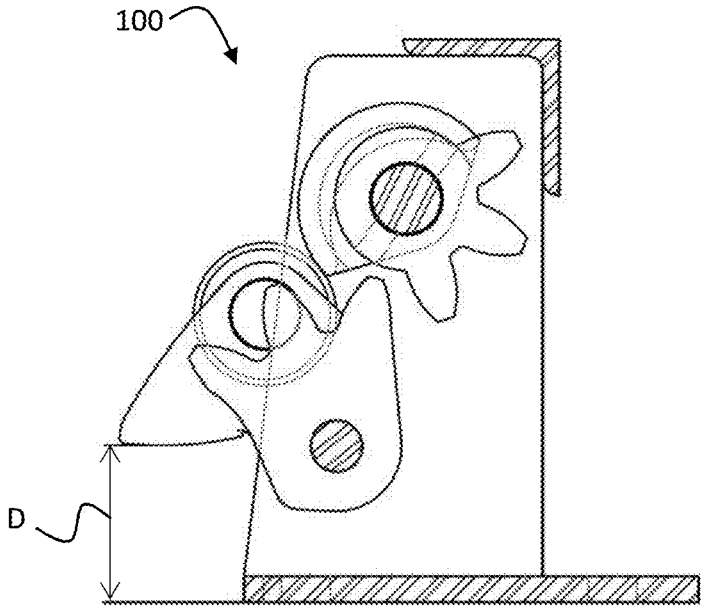
Fig. 2 (Prior Art)
Figure 3:
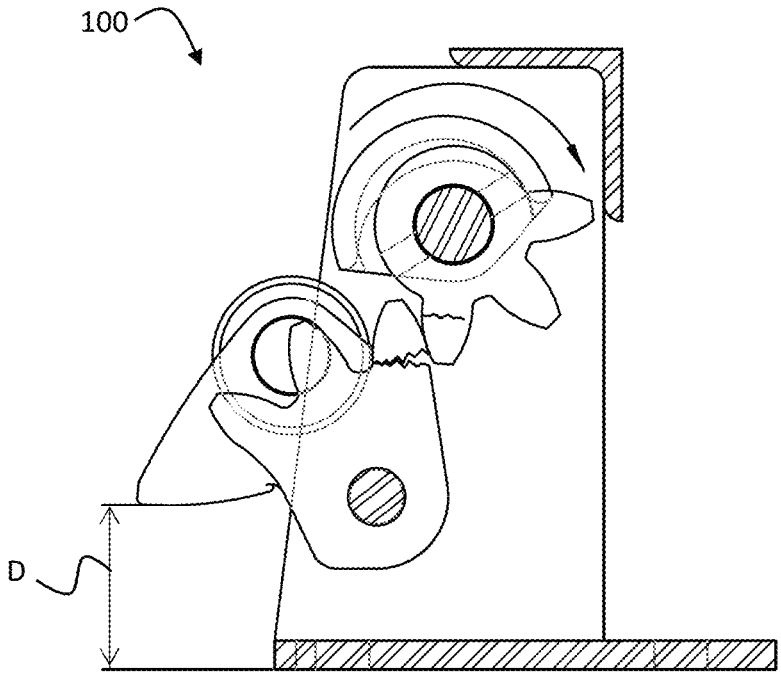
Fig. 3 (Prior Art)

FIGS. 1-3 are side views of a clamp 100 known in the prior art. The clamp 100 includes a first rotating mechanism and a second rotating mechanism.

The first rotating mechanism includes a first pin 102, a cam 104, and a gear 106. The first pin 102 is a rod configured to be rotated by an external agent such as a powered torque wrench. The cam 104 and the first gear 106 are joined to the pin at different locations along a longitudinal axis of the pin, and are configured to rotate with the first pin 102. The outer surface of the cam 104 has a cylindrical section 104*a* that describes an arc of a cylinder that is off-center from the longitudinal axis of the first pin 102. The first gear 106 has at least one tooth extending radially away from the first pin 102. The at least one tooth is on a side of the gear which is adjacent to the non-cylindrical section of the cam 104 and is opposite the cylindrical section 104*a* of the cam 104.

The second rotating mechanism includes a second pin 108, a second gear 110, and a pawl 112, and a roller 114. The second gear 110 and the pawl are joined to the second pin 108 at different locations along a longitudinal axis of the second pin and are configured to rotate with the second pin 108.

The second pin 108 is parallel to the first pin 102. The roller 114 contacts the cylindrical section of 104*a* of the cam 104 and is joined to the pawl 112 such that the rotation of the roller 114 does not cause the pawl 112 to rotate. As the cam 104 rotates clockwise, the distance between the point at which the cam touches the roller from the center of the first pin 102 becomes larger, due to the fact that the cylindrical section 104*a* is off-center with respect to the rotation axis (longitudinal axis) of the first pin 102. Therefore, the cam's clockwise rotation pushes the roller and therefore causes the whole second rotation mechanism to rotate counterclockwise with respect to the second pin 108. This rotation causes the pawl to increase pressure on the anode rod.

As the anode rod wears down, the first rotation mechanism is rotated counterclockwise to rotate the second rotation mechanism clockwise and decrease the distance D between the pawl's clamping pad 112*a* and the base upon which the clamp is placed.

In FIG. 1, the clamp 100 is at a configuration in which the clamping pad 112*a* start exerting pressure on the anode rod located under the clamping rod. In FIG. 2, the clamp 100 is at a configuration in which the first pin 102 is rotated counterclockwise to keep the pressure on the anode constant, after the anode rod has worn off and decreased in height.

In FIG. 3, as the anode rod wears down more, the first pin 102 is rotated further and the cam loses contact with the roller. The inventor has found that due to the high torque applied to the cam, the cam rotates violently, causing the tooth of the first gear 106 to make contact with the tooth of the second gear 110. This violent contact may cause the teeth of the first and/or second gear to break. There is therefore a need for a new design of an anode clamp to decrease the chance of breakage of the cam.

Figure 4:
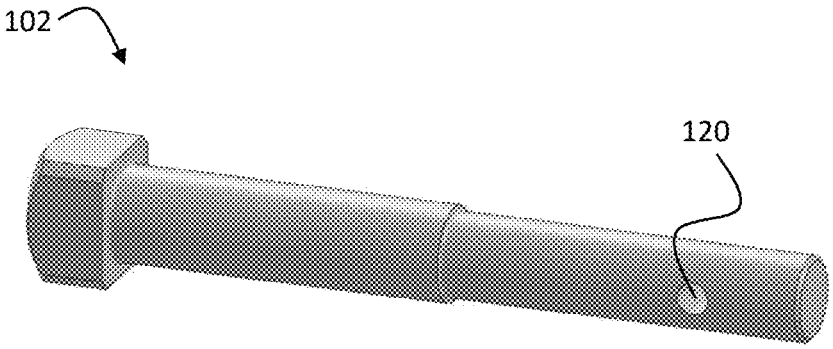
Fig. 4 (Prior Art)
FIGS. 4-6 are different views of a first pin of FIGS. 1-3, as known in the general art.
Figure 5:
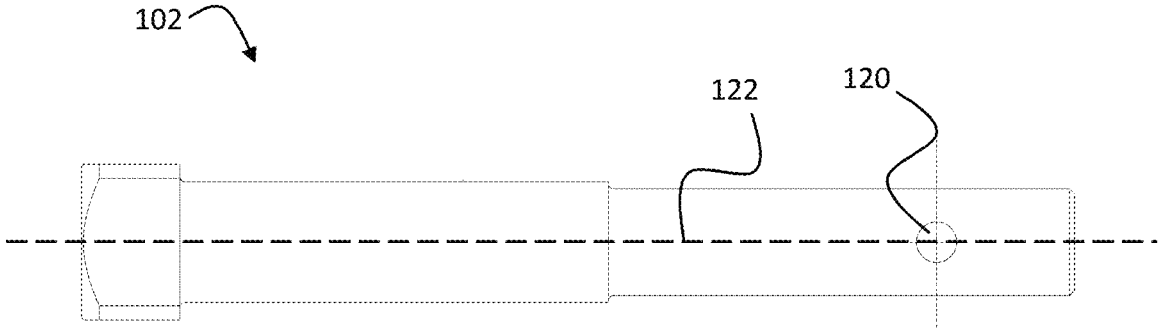
Fig. 5 (Prior Art)
Figure 6:
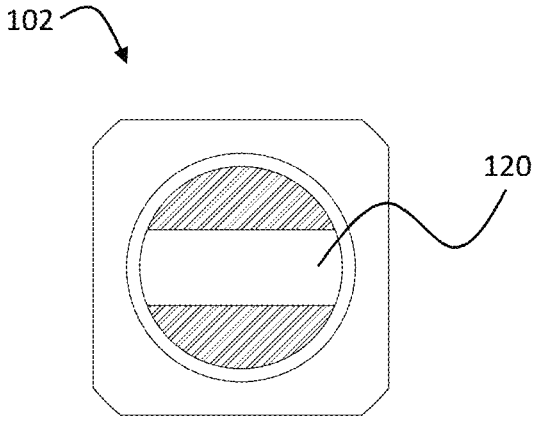
Fig. 6 (Prior Art)

FIGS. 4-6 illustrate the first pin 102 as known in the prior art. FIG. 4 is a perspective view of the first pin 102. FIG. 5 is a side view of the first pin 102. FIG. 6 is a cross-sectional front view of the first pin 102.

The first pin 102 has a hole 120. The hole 120 traverses the first pin 102 and is perpendicular to the longitudinal (and rotational) axis 122 of the first pin 102. The hole 120 is configured for being traversed by a dowel pin which is also connected to the apparatus formed by the cam and the first gear, thereby joining the cam and the first gear to the first pin 102. The inventor has found that because the great torque applied on the first pin 102, the first pin 102 was also prone to breakage. There is therefore a need for a new design of an anode clamp to decrease the chance of breakage of the first pin.

Figure 7:
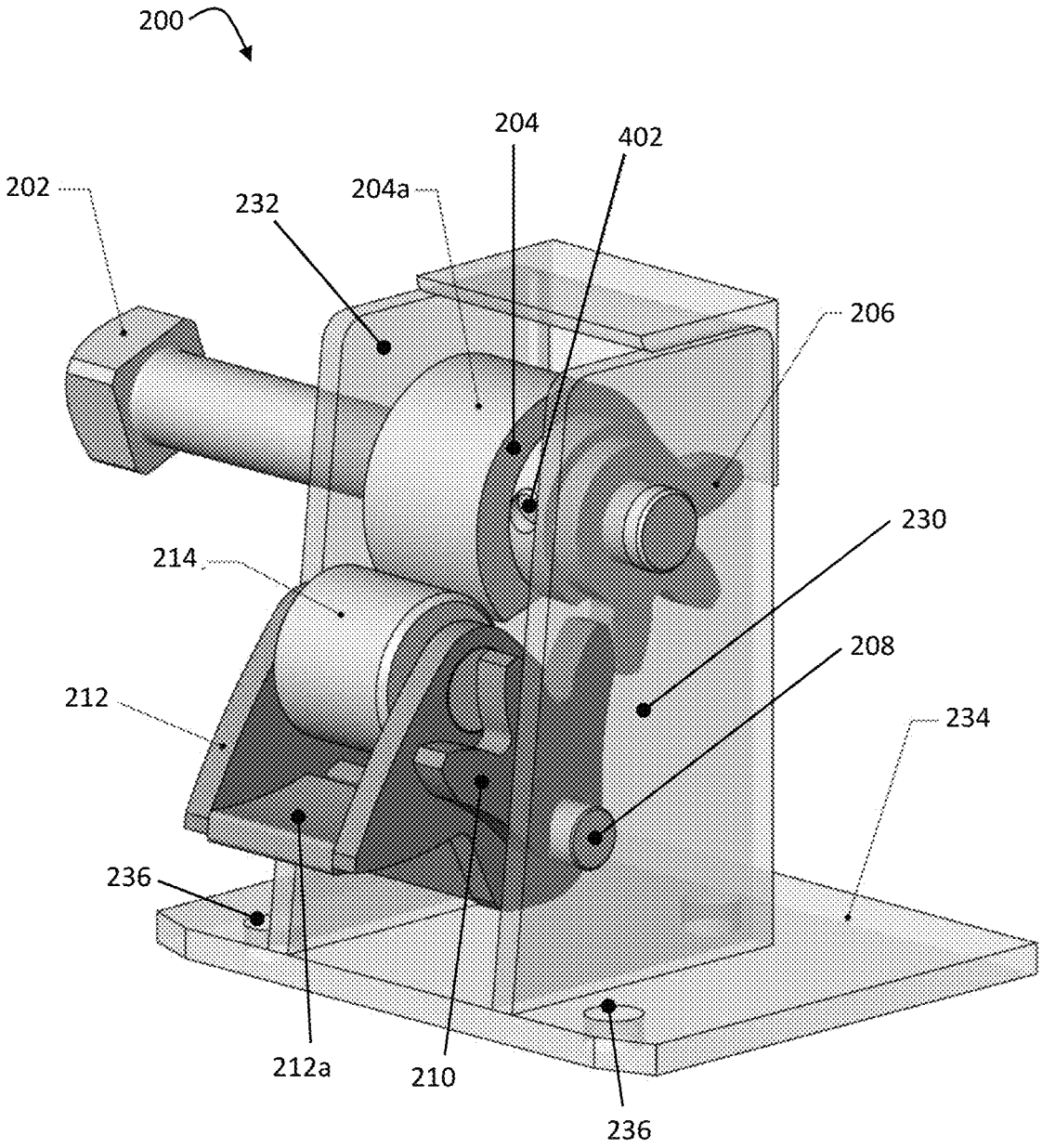
FIG. 7 is a perspective view of an anode clamp, according to some embodiments of the present invention.

FIG. 7 is a perspective view of an anode clamp 200, according to some embodiments of the present invention. The anode clamp 200 includes a first rotating mechanism and a second rotating mechanism.

The first rotating mechanism includes a first pin 202, a cam 204, and a first gear 206. The first pin 202 is a rod configured to be rotated around a longitudinal axis thereof by a user via an external agent, such as a powered torque wrench. In some embodiments of the present invention, the first pin 202 has a polygonal head (e.g., square) configured for being held by an external agent/machine and be rotated thereby. The cam 204 and the first gear 206 are joined to the first pin 202 at different locations along a longitudinal axis of the pin, and are configured to rotate with the first pin 202. The cam has a main body shaped like cylindrical arc: that is, outer surface of the cam 204 has a cylindrical section 204*a* that describes an arc of a cylinder that is off-center from the longitudinal axis of the first pin 202. The cam 204 is joined to the first pin such that the central axis of the cylinder is parallel to the longitudinal axis of the pin. The first gear 206 has at least one tooth extending radially away from the first pin 202. The at least one tooth is on a side of the gear which is adjacent to the non-cylindrical section of the cam 204 and is opposite to the cylindrical section 204*a* of the cam 204.

The second rotating mechanism includes a second pin 208, a second gear 210, and a pawl 212, and a roller 21*t*4. The second pin 208 is parallel to the first pin 202. The second gear 210 and the pawl are joined together and are joined to the second pin 208 at different locations along a longitudinal axis of the second pin and are configured to rotate with or around the second pin 208.

The roller 214 is parallel to the cam 204 and to the first pin 202, is configured to contact the cylindrical section of 204*a* of the cam 204, and is joined to the pawl 212 such that the rotation of the roller 214 does not cause the pawl 212 to rotate. As the cam 204 rotates in a first direction (e.g. clockwise), the distance between the point at which the cam touches the roller from the center of the first pin 202 becomes larger, due to the fact that the cylindrical section 204*a* is off-center with respect to the rotation axis (longitudinal axis) of the first pin 202. Therefore, the cam's rotation in a first direction (e.g. clockwise) pushes the roller 204 and therefore causes the whole second rotation mechanism to rotate in the opposite direction (counterclockwise) with respect to the second pin 208. This rotation causes the pawl's clamping pad 212*a* to increase pressure on the anode rod located under the clamping pad.

As the anode rod wears down, the first rotation mechanism is rotated further in the first direction (e.g., clockwise) in order to rotate the second rotation mechanism further in the second direction (e.g. counterclockwise) and to decrease the distance between the pawl's clamping pad 212*a* and the stand upon which the clamp 202 is placed (e.g., the anode bus).

In the present invention, the size of the arc described by the cylindrical section 204*a* and the orientation is first gear 206 is chosen so that at least one tooth of the first gear 206 touches at least one tooth of the second gear 210 before the cam 204 loses contact with the roller 214. In this manner, the loss of contact between the cam 204 and the roller 214 does not cause a violent rotation of the first gear 206 and does not cause a tooth of the first gear to violently clash against a tooth of the second gear. In this manner, the teeth of the first and/or second gear are less prone to breakage.

The first and second rotating mechanism are optionally held and supported by a first vertical wall 230 and a second vertical wall 232 joined to a horizontal base 234. The walls 230 and 232 have first apertures for receiving the first pin 202 and second apertures for receiving the second pin 208. The first apertures and the second apertures are placed so that the first pin is parallel to the second pin and so that the rotation axes of the first and second pins are parallel to the horizontal base 234.

In some embodiments of the present invention the base 234 has one or more openings 236. The openings 236 correspond to respective openings on the anode bus (not shown). The openings 237 and the respective openings on the anode bus may be traversed by screws or bolts, in order to join the clamp 200 and the anode bus.

In some embodiments of the present invention, the cam and the roller are made of iron or steel. In some embodiments of the present invention, the cam and roller are made of 1144 CF steel.

Figure 8:
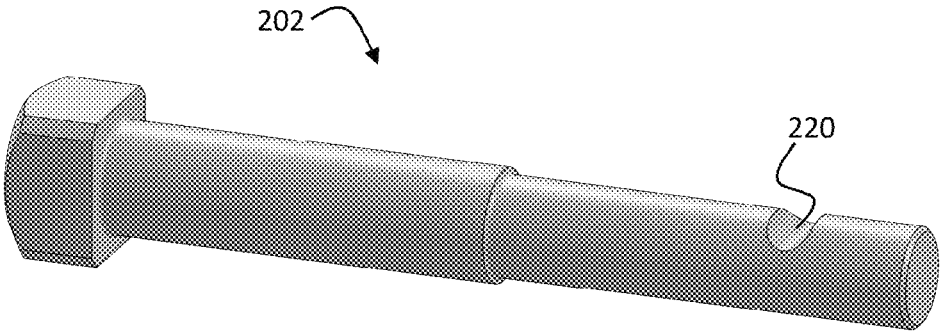
FIGS. 8-10 illustrate an example of a first pin of an anode clamp, according to some embodiment of the present invention.
Figure 9:
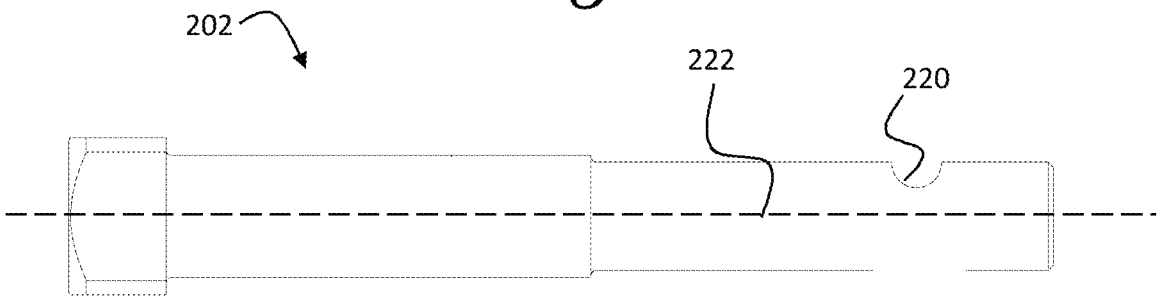
Figure 10:
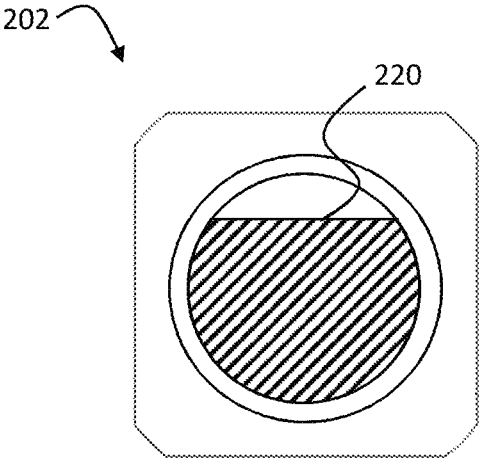

FIGS. 8-10 illustrate an example of the first pin 202 of an anode clamp, according to some embodiments of the present invention. FIG. 8 is a perspective view of the first pin 202. FIG. 9 is a side view of the first pin 202. FIG. 10 is a cross-sectional front view of the first pin 202.

An open channel 220 is cut near the top of the first pin. In some embodiments of the present invention, the open channel 220 is substantially perpendicular to the longitudinal axis 222 of the first pin 202. As will be described further in the present document, the open channel is configured for accommodating a dowel pin that is configured for joining the cam to the first pin 202.

The open channel 220 has a smaller volume than the hole 120 of FIGS. 4-6. This is especially clear by comparing the FIG. 6 to FIG. 10. The cross-sectional area of the "full" portion in FIG. 10 is larger than the corresponding cross-sectional area in FIG. 6. This increases the torsional strength of the first pin, increases the service life of the square pin, and reduces the maintenance required.

Figure 11:
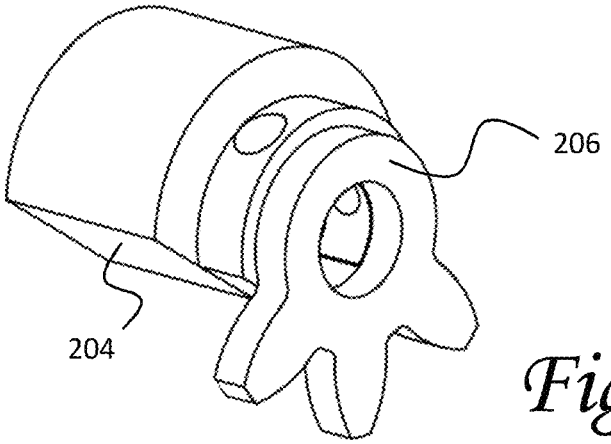
FIG. 11 is a perspective view of a cam-gear assembly of an anode clamp, according to some embodiments of the present invention.
Figure 12A:
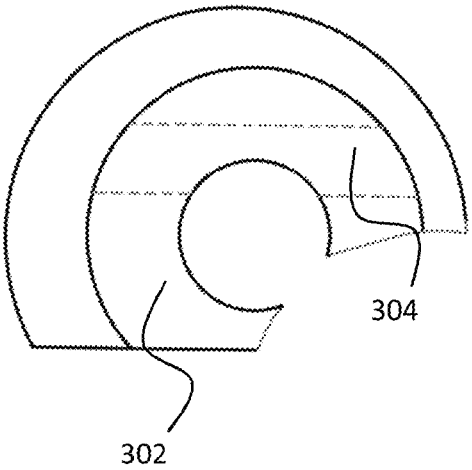
FIGS. 12*a* and 12*b* are respectfully a side view and a front view of the cam of an anode clamp, according to some embodiments of the present invention.
Figure 12B:
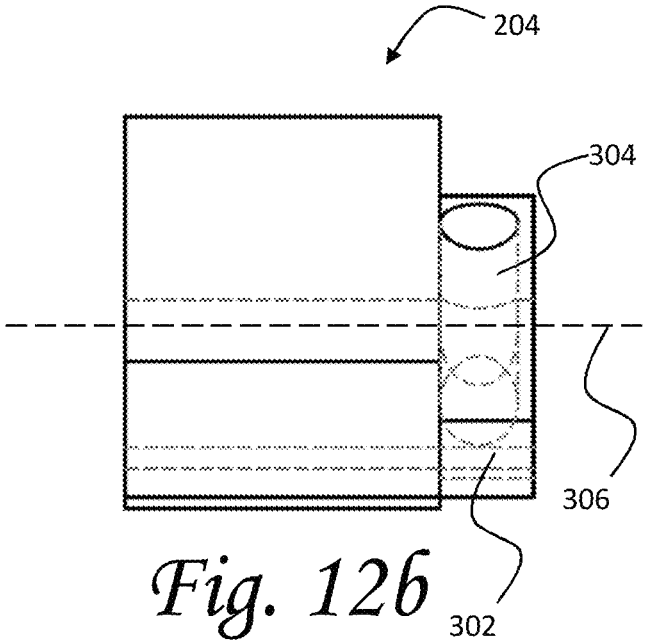
Figure 13:
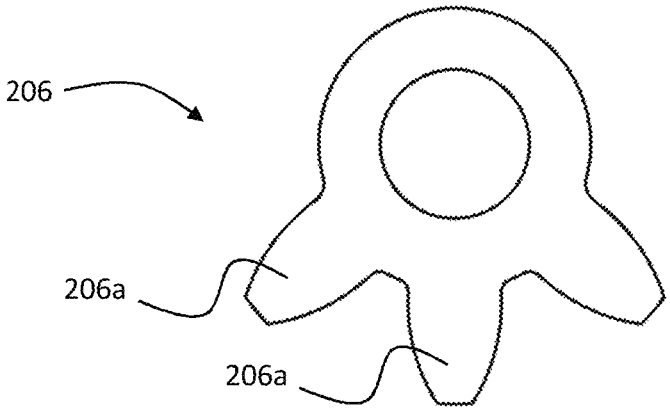
FIG. 13 is a side view of the first gear of an anode clamp, according to some embodiments of the present invention.

FIG. 11 is a perspective view of a cam-gear assembly of an anode clamp, according to some embodiments of the present invention. FIG. 12*a* is a side view of the cam of an anode clamp, according to some embodiments of the present invention. FIG. 12*b* is a front view of the cam of an anode clamp, according to some embodiments of the present invention. FIG. 13 is a side view of the first gear of an anode clamp, according to some embodiments of the present invention.

The cam-gear assembly includes the cam 204 and the first gear 206. The cam 204 and the first gear 206 are configured to be traversed by the first pin. The cam-gear assembly may be cast as a single unit or may be made by separate pieces joined together. For example, the cam 204 and the first gear 206 may be fabricated separately and then joined together by any known means. For example, the cam 204 and the first gear 206 may be welded together or be joined together via pins, screws, bolts, etc. The different pieces may be fabricated from steel plate (e.g., a36 steel plate). The individual components may be cut on a burning table then welded together in a jig to form the completed assembly. Steel material has 30% stronger tensile strength while being lighter, aiding in assembly. Dimensional shape is more consistent, greatly improving part fitment in the clamp.

In some embodiments of the present invention, the cam 206 includes an extension 302 extending longitudinally away from the main body of the cam. The extension is traversed by a hollow, straight duct 304 that is perpendicular to the longitudinal axis 306 of the cylindrical main body. The duct 304 two openings configured for receiving a dowel pin inside the duct. A portion of the duct 304 is an open channel. When the cam 204 is traversed by the first pin, the open channel of the first pin closes the open channel of the cam to form a closed conduit configured to hold the dowel pin, as shown in FIG. 15, described further below.

The first gear 206 is a loop that has one or more to eth 206*a* extending radially outward. The loop is configured to be traversed by the first pin.

Figure 14:
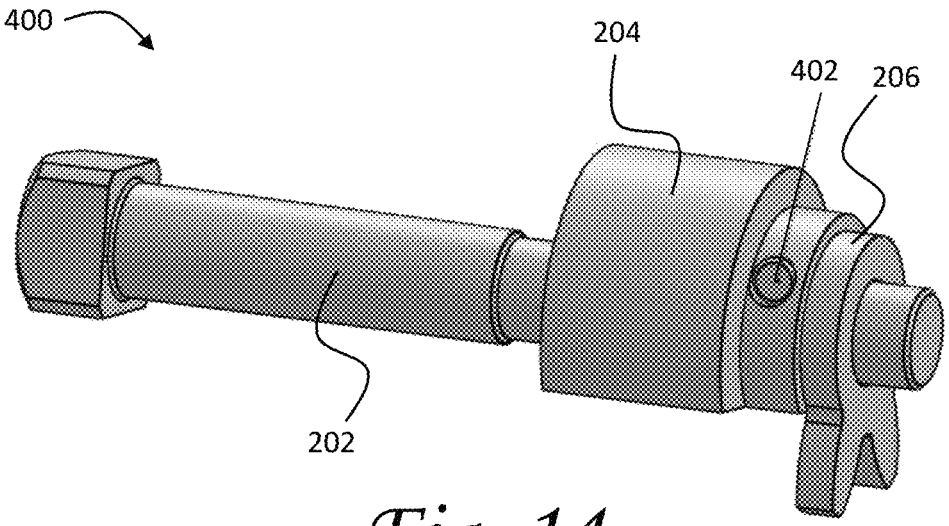
FIGS. 14-17 illustrate the first rotation mechanism of an anode clamp, according to some embodiments of the present invention.
Figure 15:
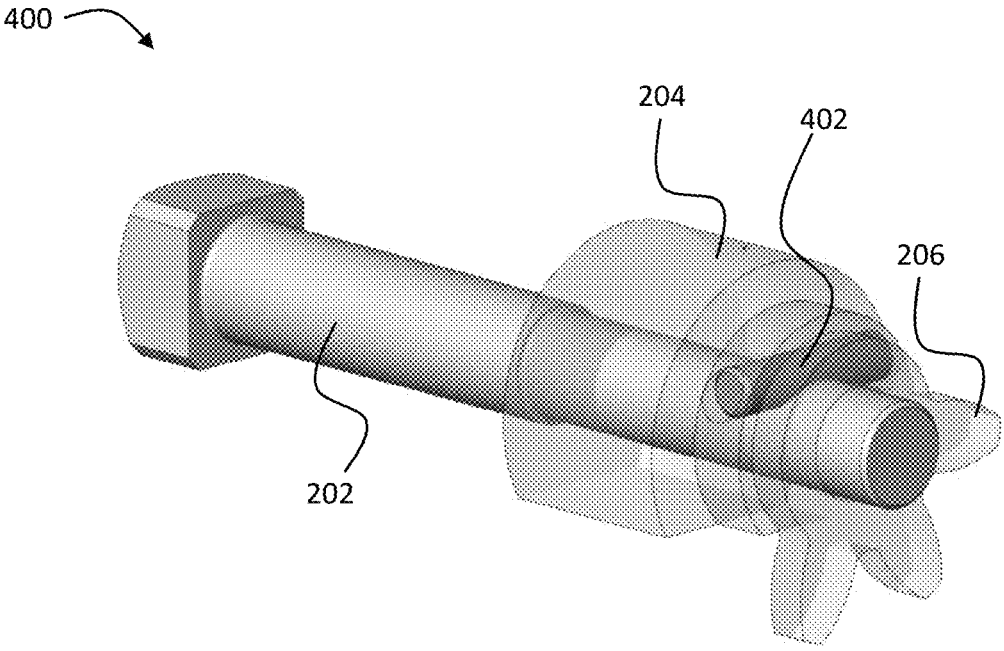
Figure 16:
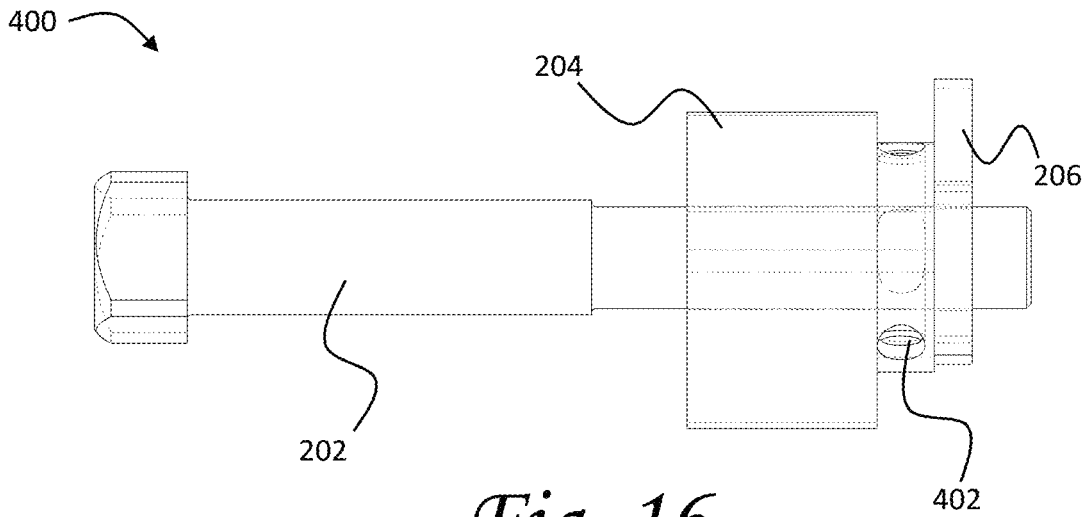
Figure 17:
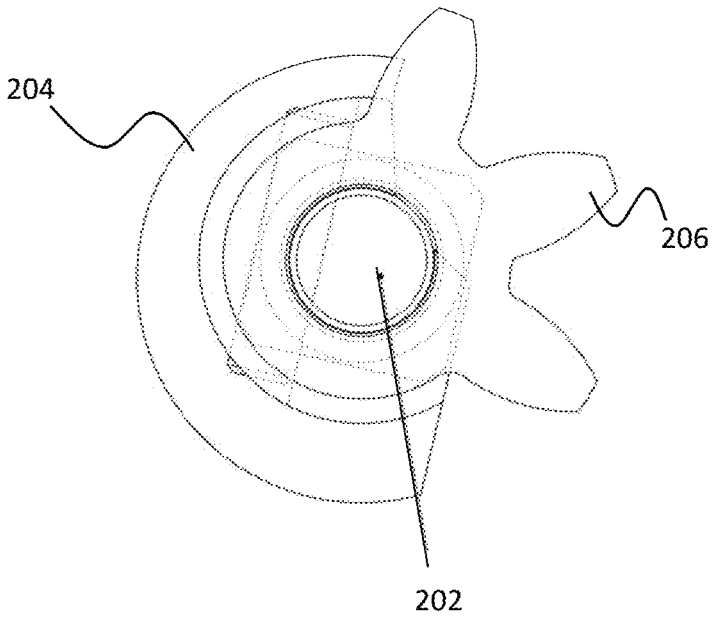

FIGS. 14-17 illustrate the first rotation mechanism 400 of an anode clamp, according to some embodiments of the present invention. FIG. 14 is a perspective view of the first rotation mechanism 400. FIG. 15 is a perspective view of the first rotation mechanism 400, where the cam 204 and the first gear 206 are translucent to reveal the position of the dowel pin 402. FIG. 16 is a front view of the first rotation mechanism. FIG. 17 is a side view of the first rotation mechanism 400.

The first rotation mechanism 400 includes the first pin 202, the cam 204, and the first gear 206. The cam 204 is and the first gear 206 are joined to the first pin 202 and are configured to rotate with the first pin.

In some embodiments of the present invention, the cam 204 and the first gear 206 are joined together to form a cam-gear assembly. The cam-gear assembly is traversed by the first pin 202 and joined to the first pin 202. In some embodiments of the present invention, the cam 204 and the first gear 206 are separately joined to the first pin 202.

According to some embodiments of the present invention, the cam includes an extension having a duct having openings to receive a dowel pin 402, as explained above. To assemble the first rotation mechanism, the first pin 202 is inserted into the cam 204 until an open channel section of the cam's duct is aligned with the open channel of the first pin to form a closed conduit configured to hold the dowel pin. As the first pin 202 rotates, the dowel pin 402 transfers torque from the first pin 202 to the cam 204, causing the cam 204 to rotate with the first pin.

Figure 18:
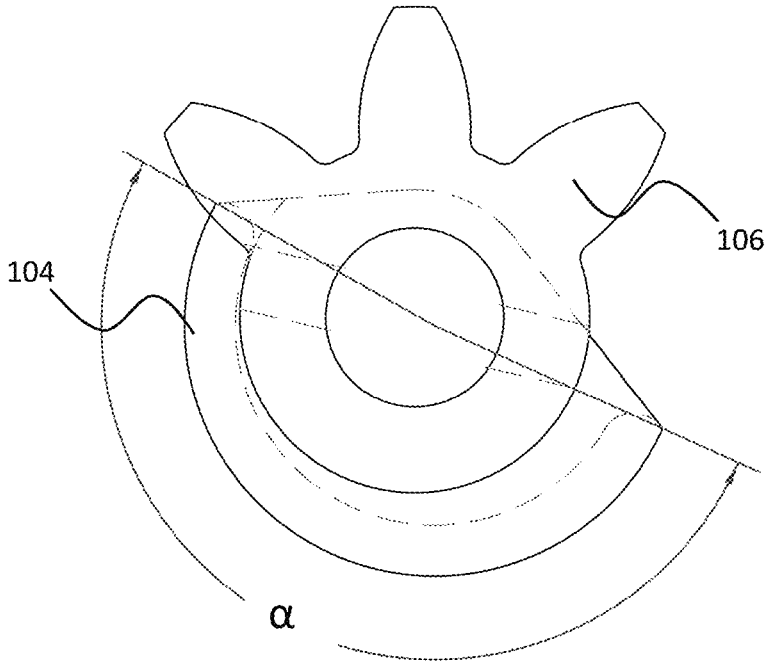
Fig. 18 (Prior Art)
FIG. 18 is a side view of a cam-gear assembly as known in the general art.
Figure 19:
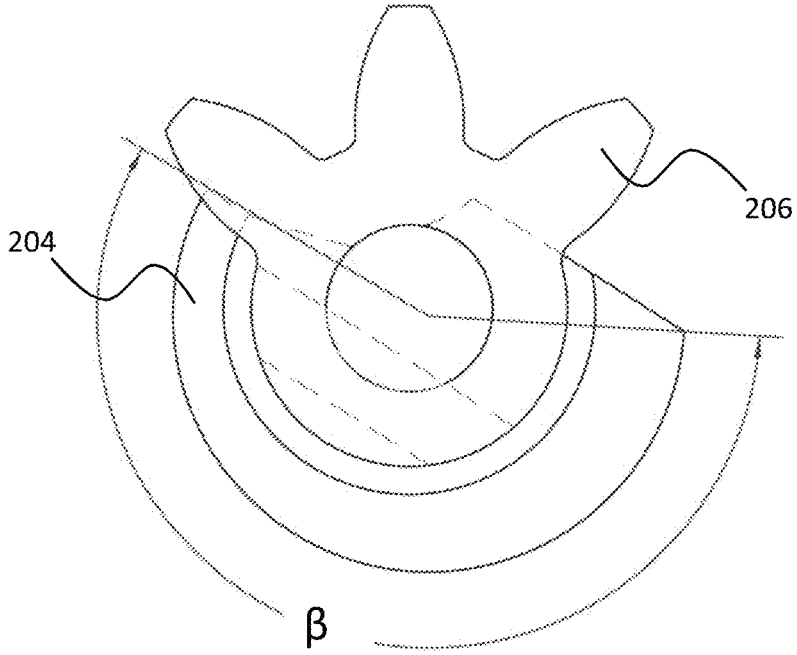
FIG. 19 is a side view of a cam-gear assembly, according to some embodiments of the present invention.

FIG. 18 is a side view of a cam-gear assembly as known in the general art. FIG. 19 is a side view of a cam-gear assembly, according to some embodiments of the present invention.

In the prior art, the cylindrical arc described by the cam 104 has an angle $\alpha$ of about 185 degrees. In the present invention, the cylindrical arc described by the cam 204 has an angle $\beta$. Optionally, the angle $\beta$ is larger than the angle $\alpha$. The angle $\beta$ may be for example, in the range between 200 and 207 degrees. This allows the cam 204 to travel more before losing contact with the roller. In this manner, the first tooth of the first gear 206 is closer to the end of the of the arc, so that the first tooth of the first gear 206 touches a tooth of the second gear before the cam 204 loses contact with the roller.

Figure 20:
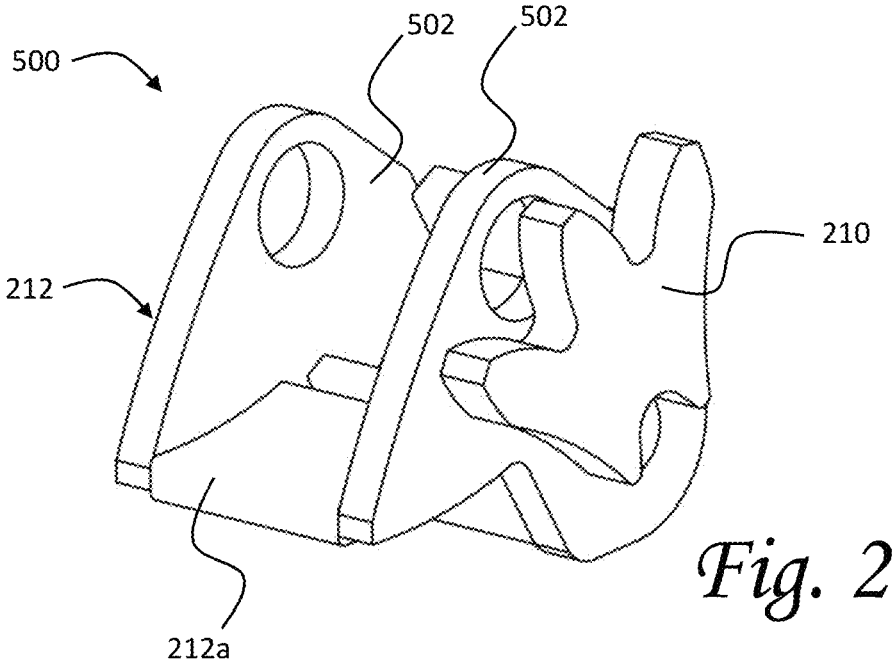
FIG. 20 is a perspective view of a pawl-gear assembly, according to some embodiments of the present invention.
Figure 21:
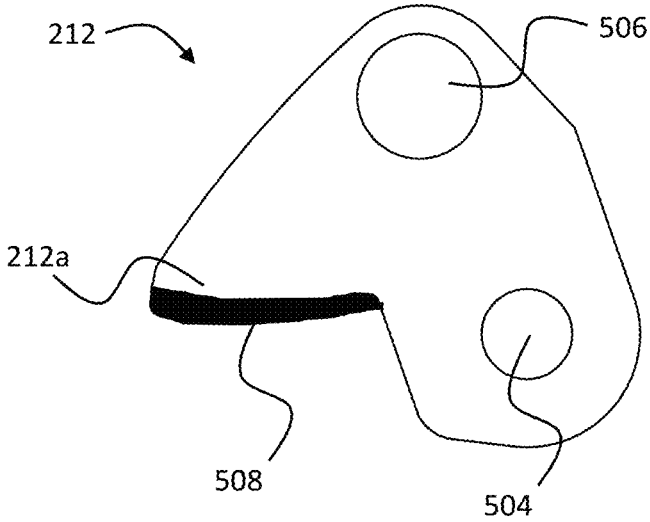
FIG. 21 is a side view of a pawl, according to some embodiments of the present invention.
Figure 22:
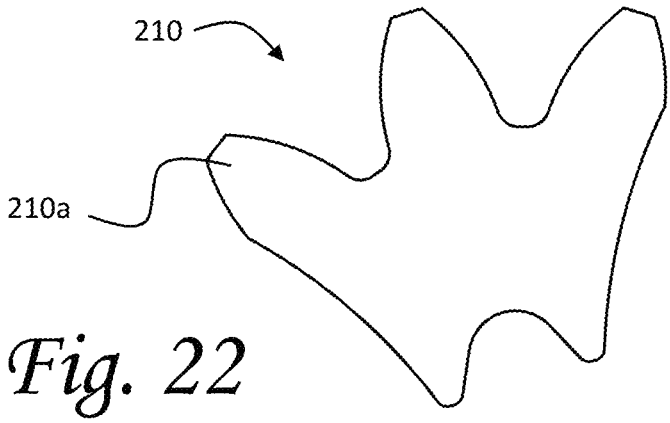
FIG. 22 is a side view of a second gear, according to some embodiments of the present invention.

FIG. 20 is a perspective view of a pawl-gear assembly, according to some embodiments of the present invention. FIG. 21 is a side view of a pawl, according to some embodiments of the present invention. FIG. 22 is a side view of a second gear, according to some embodiments of the present invention.

The pawl-gear assembly 500 includes the pawl 212 and the second gear 210. The pawl-gear assembly 500 may be cast as a single unit or may be formed by different units each fabricated individually and joined together by any known means. For example, the different units may be welded together or be joined together via pins, screws, bolts, etc.

The pawl 212 includes two parallel vertical walls 502 and a clamping pad 212*a* extending between the two vertical walls 502. Each wall 502 has a first opening 504 and a second opening 506. The first openings 504 are configured for being traversed by and secured to the second pin 208 such that the pawl 212 rotates around the second pin 208 of FIG. 7 or with the second pin 208 of FIG. 7. The second openings 506 are configured for being partially traversed by the roller 214 of FIG. 7, such that the roller 214 rotates without causing rotation of the pawl 212.

The clamping pad 212*a* is the unit that comes into contact with the anode rod and applies pressure on the anode rod. In some embodiment of the present invention, the pawl 212 includes an electrically insulating block 508 joined to the clamping pad and configured to prevent electrical current flow through the clamp, thus preventing high temperatures sometimes experienced through the electric current flow.

In some embodiments of the present invention, the pawl 212 is cast as a single unit. In some embodiments of the present invention, the walls 502 and the clamping pad 212*a* are individually fabricated and then joined together by any known means (welded together, or via screws, bolts, etc.). The different pieces may be fabricated from steel plate (e.g., a36 steel plate). The individual components may be cut on a burning table then welded together in a jig to form the completed assembly. Steel material has 30% stronger tensile strength while being lighter, aiding in assembly. Dimensional shape is more consistent, greatly improving part fitment in the clamp.

The second gear 210 includes one or more teeth 210*a* and is joined to the pawl, so that the second gear 210 rotates with the pawl 212 around the second pin 208.

FIGS. 23-27 are side-view drawings of an anode clamp illustrating different arrangements of the anode clamp 200, according to some embodiments of the present invention.

Figure 23:
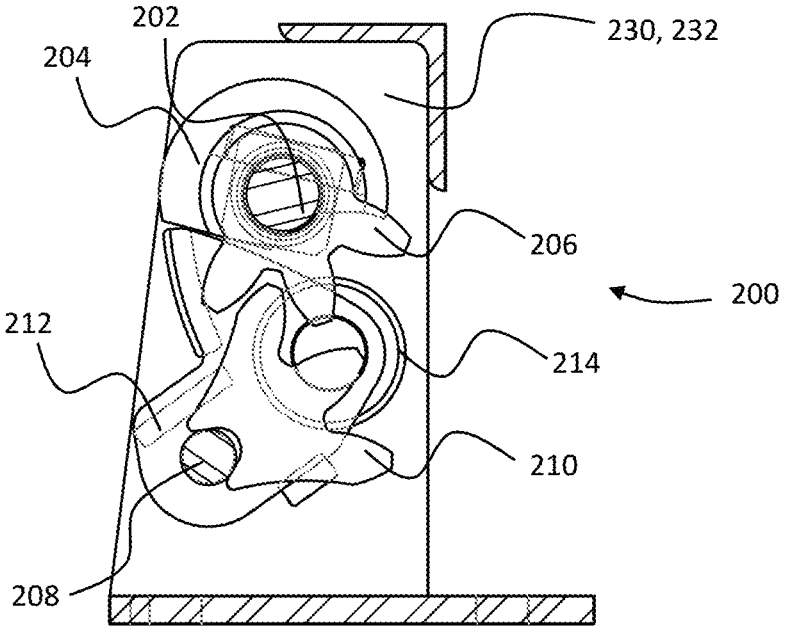
FIGS. 23-27 are side-view drawings of an anode clamp illustrating different arrangements of the anode clamp, according to some embodiments of the present invention.
Figure 24:
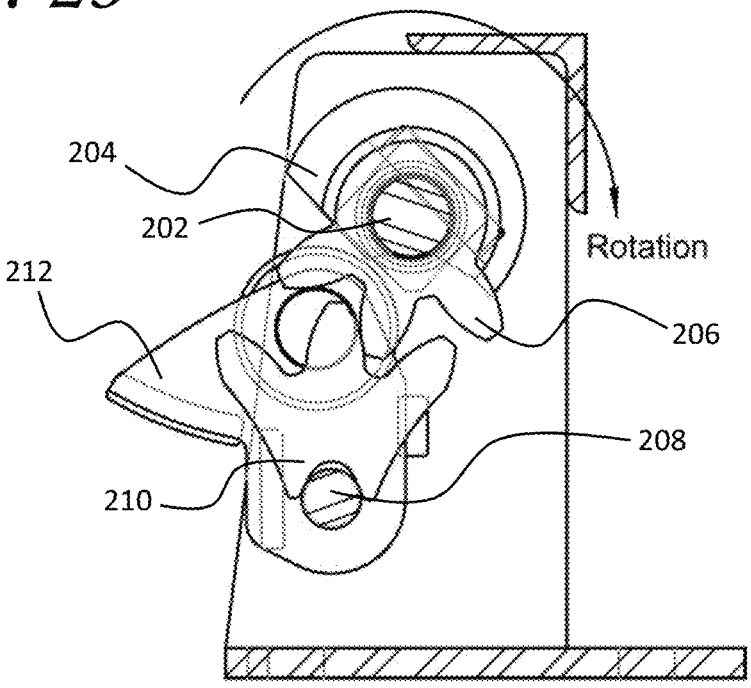

In FIG. 23, the anode clamp 200 is in a resting position, in which the pawl's clamping pad is retracted within the walls 230 and 232. In FIG. 24, the first pin 202 pin is rotated clockwise, the gear teeth of the first gear 206 push the teeth of the second gear 110 and cause the pawl 212 to rotate counterclockwise around the second pin 208. The pawl 212 beings to move to make contact with the anode.

Figure 25:
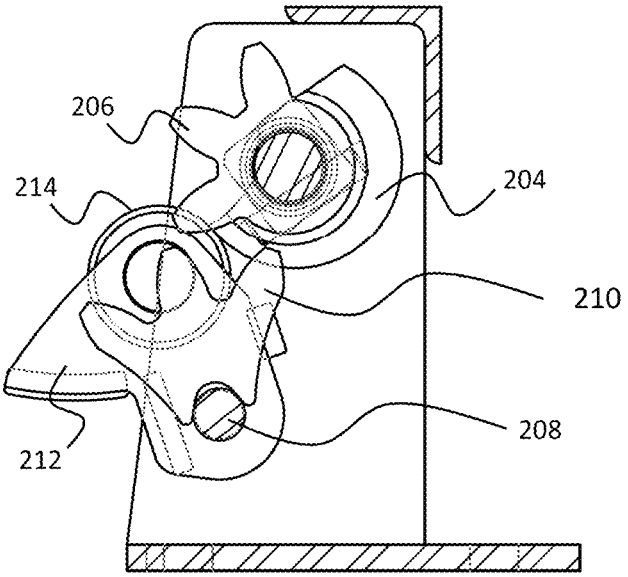

In FIG. 25, the pawl 212 has made contact with anode to be clamped. The teeth of the first gear 206 and the teeth of the second gear 210 are no longer in contact with one another. The cylindrical section 204*a* of the cam 204 contacts roller 214. This is where clamping of the anode begins.

Figure 26:
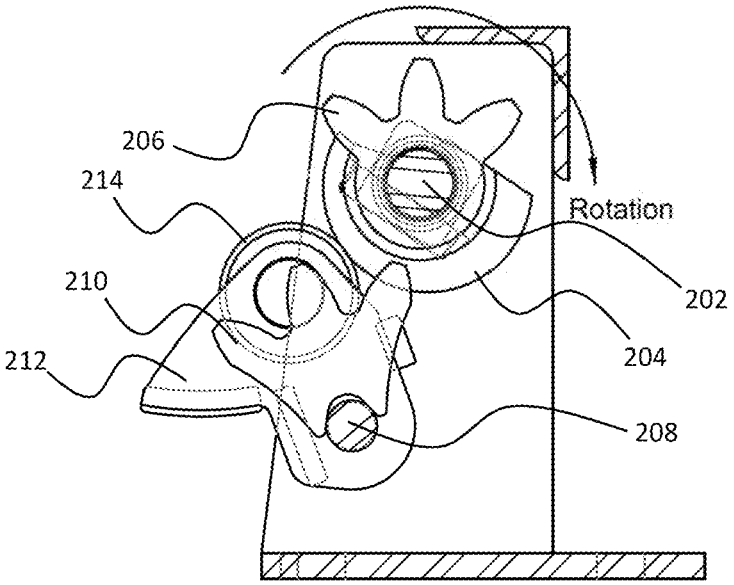
Figure 27:
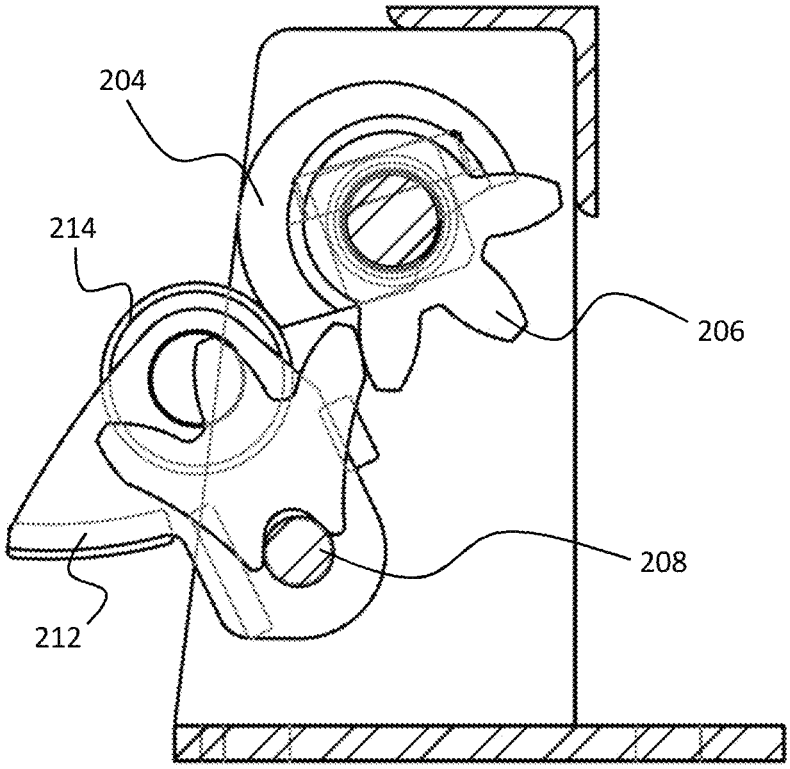
Figure 29:
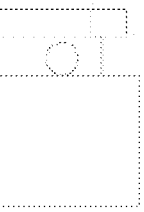
FIG. 29 is a top view of the cam-gear assembly, according to some embodiments of the present invention.
Figure 32:
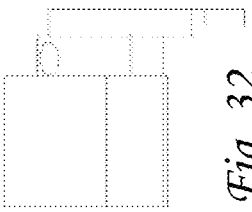
FIG. 32 is a front view of the cam-gear assembly, according to some embodiments of the present invention.
Figure 34:
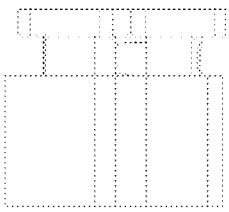
FIG. 34 is a bottom view of the cam-gear assembly, according to some embodiments of the present invention.
Figure 28:
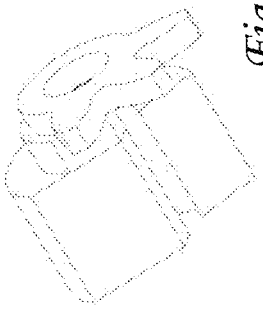
FIG. 28 is a perspective bottom view of the cam-gear assembly, according to some embodiments of the present invention.
Figure 31:
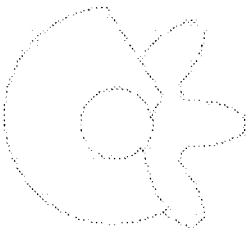
FIG. 31 is a left-side view of the cam-gear assembly, according to some embodiments of the present invention.
Figure 30:
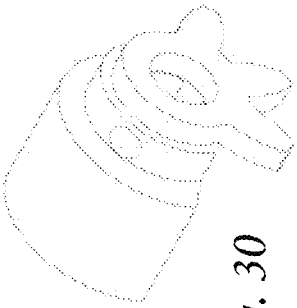
FIG. 30 is a perspective top view of the cam-gear assembly, according to some embodiments of the present invention.
Figure 33:
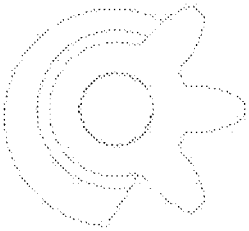
FIG. 33 is a right-side view of the cam-gear assembly, according to some embodiments of the present invention.
Figure 35:
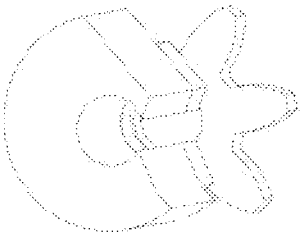
FIG. 35 is a perspective left-side view of the cam-gear assembly, according to some embodiments of the present invention.
Figure 36:
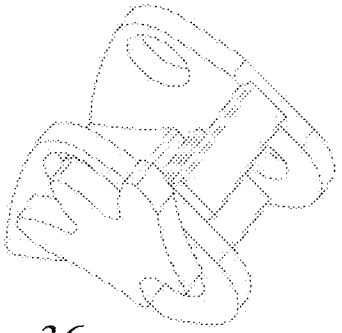
FIG. 36 is a perspective back view of the pawl-gear assembly, according to some embodiments of the present invention.
Figure 37:
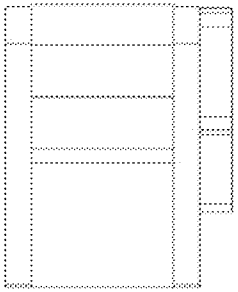
FIG. 37 is a top view of the pawl-gear assembly, according to some embodiments of the present invention.
Figure 38:
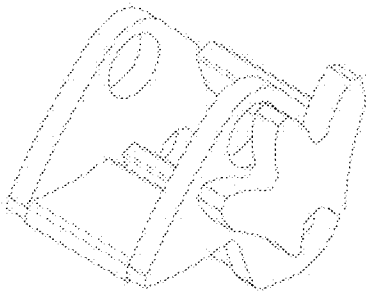
FIG. 38 is a perspective front view of the pawl-gear assembly, according to some embodiments of the present invention.
Figure 39:
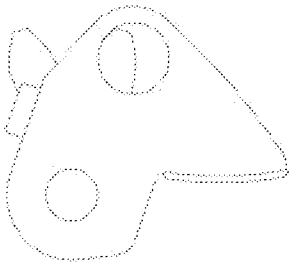
FIG. 39 is a left-side view of the pawl-gear assembly, according to some embodiments of the present invention.
Figure 40:
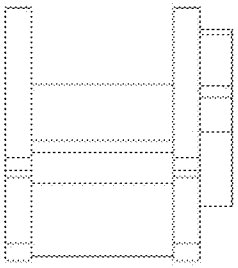
FIG. 40 is a front view of the pawl-gear assembly, according to some embodiments of the present invention.
Figure 41:
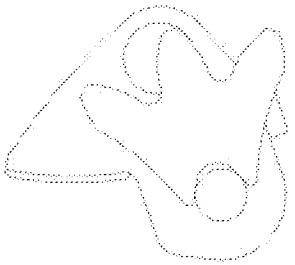
FIG. 41 is a right-side view of the pawl-gear assembly, according to some embodiments of the present invention.
Figure 42:
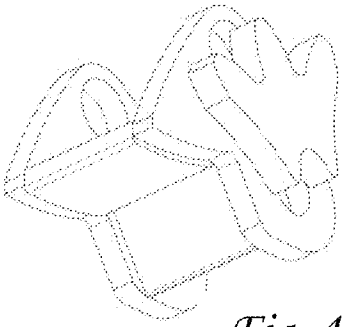
FIG. 42 is a perspective bottom view of the pawl-gear assembly, according to some embodiments of the present invention.
Figure 43:
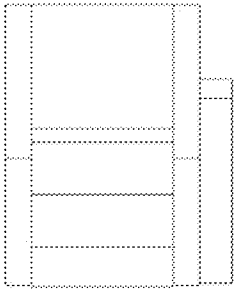
FIG. 43 is a bottom view of the pawl-gear assembly, according to some embodiments of the present invention.
Figure 44:
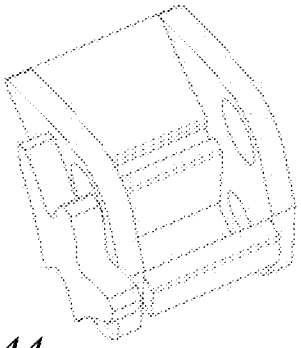
FIG. 44 is a perspective top view of the pawl-gear assembly, according to some embodiments of the present invention.
Figure 49:
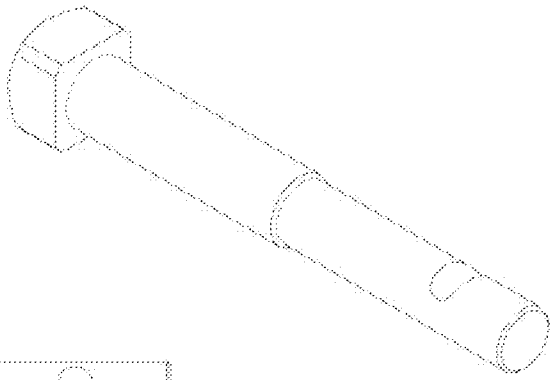
FIG. 49 is a perspective top view of the first pin, according to some embodiments of the present invention.
Figure 50:
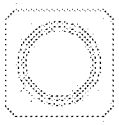
FIG. 50 is a right-side view of the first pin, according to some embodiments of the present invention.
Figure 46:
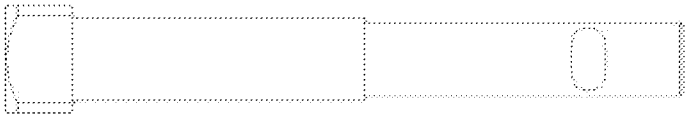
FIG. 46 is a top view of the first pin, according to some embodiments of the present invention.
Figure 47:
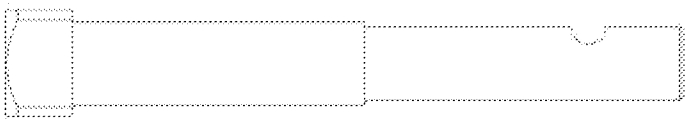
FIG. 47 is a front view of the first pin, according to some embodiments of the present invention.
Figure 48:
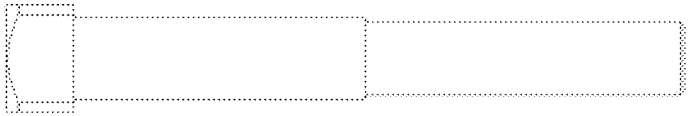
FIG. 48 is a bottom view of the first pin, according to some embodiments of the present invention.
Figure 45:
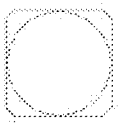
FIG. 45 is a left-side view of the first pin, according to some embodiments of the present invention.
Figure 53:
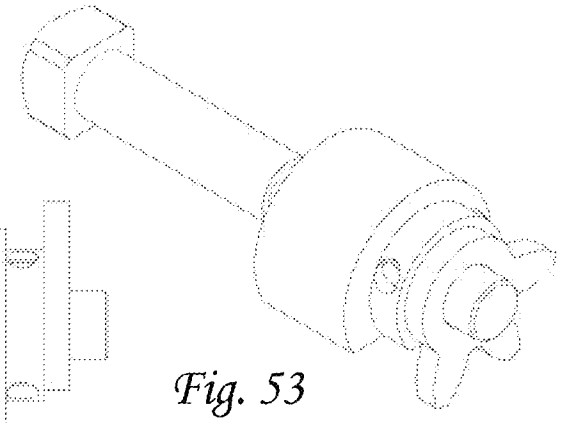
FIG. 53 is a perspective front view of the first rotating mechanism, according to some embodiments of the present invention.
Figure 56:
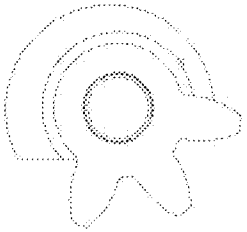
FIG. 56 is a right-side top view of the first rotating mechanism, according to some embodiments of the present invention.
Figure 52:
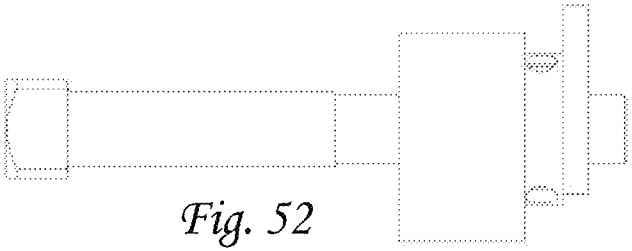
FIG. 52 is a top view of the first rotating mechanism, according to some embodiments of the present invention.
Figure 55:
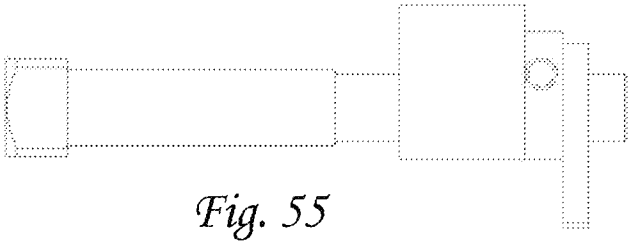
FIG. 55 is a front view of the first rotating mechanism, according to some embodiments of the present invention.
Figure 57:
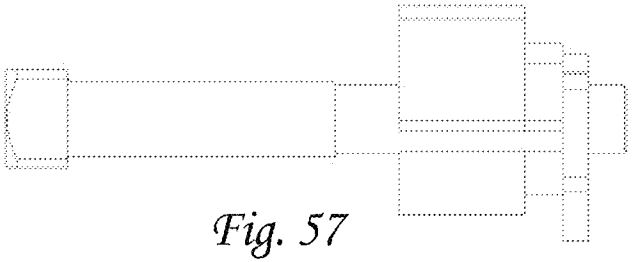
FIG. 57 is a bottom view of the first rotating mechanism, according to some embodiments of the present invention.
Figure 51:
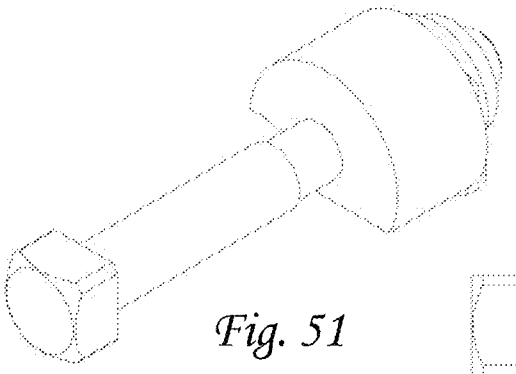
FIG. 51 is a perspective top view of the first rotating mechanism, according to some embodiments of the present invention.
Figure 54:
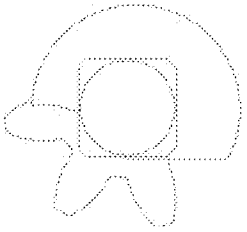
FIG. 54 is a left-side view of the first rotating mechanism, according to some embodiments of the present invention.

In FIG. 26, as the head of the first pin 202 is rotated, the cam 204 continues to push the pawl 212 further into the anode. In FIG. 27, the position of maximum travel of the pawl 212 is shown. In some embodiments of the present invention, this only occurs if the anode is worn beyond specification. This indicates the anode needs replacing. It is important to note that cam 204 is still in contact with roller 214 as at least one tooth of the first gear 206 touches at least one tooth of the second gear 210. This prevents damage to the clamp.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. An anode clamp configured to clamp an anode rod to an anode bus, the anode clamp comprising a first rotating mechanism and a second rotating mechanism;

the first rotating mechanism comprising:

a first pin that is rod-shaped and configured for being rotated by a user around a longitudinal axis of the first pin;

a cam having a main body shaped as an arc of a cylinder, the cam having an outer surface having a cylindrical section and a non-cylindrical section, the cam being joined to the first pin such that a central axis of the cylinder is parallel to and separate from the longitudinal axis of the first pin, the cam being configured to rotate with the first pin around the longitudinal axis of the first pin;

a first gear joined to the cam, the first gear having at least one first tooth extending radially away from the first pin, the at least one tooth being adjacent to the non-cylindrical section of the cam and opposite to the cylindrical section of the cam;

the second rotating mechanism comprising:

a second pin parallel to the first pin;

a pawl joined to the second pin and rotatable around the second pin, the pawl comprising a clamping pad configured to contact the anode rod and apply pressure on the anode rod, the clamping pad comprising an electrically insulating block configured to contact the anode rod and to prevent electrical current flow from the anode rod to the clamp;

a roller parallel to the first pin and joined to the pawl such that the rotation of the roller does not cause the pawl to rotate, the roller being configured to contact the cylindrical section of the cam's outer surface;

a second gear joined to the pawl and rotatable around the second pin, the second gear having at least one second tooth extending radially away from the second gear and configured to engage with the at least one first tooth;

wherein:

a first rotation of the first rotating mechanism in a first direction around the longitudinal axis of the first pin causes the cam to roll against the roller, such that a distance between a point at which the cam touches the roller from a center of the first pin becomes larger due to the fact that the main body of the cam is off-center with respect to the longitudinal axis of the first pin, thereby pushing the roller and causing the second rotating mechanism to rotate in a second direction opposite to the first direction around the second pin;

the second rotation of the second rotating system being such that the clamping pad of the pawl rotates downward to apply pressure on the anode rod located below the clamping pad;

during the first and second rotation, the at least one first tooth is configured to contact the at least one second tooth before the roller loses contact with the cylindrical section of the outer surface of the cam.

2. The clamp of claim 1, wherein:

the first pin has a first open channel cut near a top of the first pin, the open channel being substantially perpendicular to the longitudinal axis of the first pin;

the cam comprises an extension extending longitudinally away from the main body, the extension being traversed by a hollow straight duct perpendicular to a longitudinal axis of the main body;

the duct has two openings at a surface of the extension;

a portion of the duct is a second open channel, such that the second open channel of the duct is aligned with the first open channel when the first pin is inserted in the cam, and when the second open channel and the first open channel are aligned, the first open channel and the second open channel form a closed conduit;

the first rotating mechanism comprised a dowel pin, configured for being inserted through one of the openings into the closed conduit, thereby joining the cam with the first pin.

3. The clamp of claim 1, wherein the pawl comprises:

two vertical walls parallel to each other; and the clamping pad extending between the two vertical walls;

wherein each of the vertical walls has a first opening and a second opening, the first openings being configured to be traversed to and secured to the second pin, and the second openings being configured to be partially traversed by the roller and to secure the roller.

* * * * *